United States Patent [19]

Williams

[11] 3,977,647

[45] Aug. 31, 1976

[54] MEANS FOR CONNECTING ABUTTING FORM PANELS AND FOR MOUNTING A TIE ROD

[76] Inventor: Chester I. Williams, 1501 Madison SE., Grand Rapids, Mich. 49507

[22] Filed: Feb. 11, 1975

[21] Appl. No.: 549,074

[52] U.S. Cl. ..... 249/191; 249/45; 249/217

[51] Int. Cl.[2] ..... E04G 17/08

[58] Field of Search ..... 249/40–47, 249/190–191, 196, 213–214, 216–217, 219 R, 219 W

[56] References Cited

UNITED STATES PATENTS

| | | | |
|---|---|---|---|
| 2,074,460 | 3/1937 | Colt | 249/213 |
| 2,133,574 | 10/1938 | Roemisch | 249/213 |
| 2,164,592 | 7/1939 | Pilj | 249/213 |
| 3,077,653 | 2/1963 | Ward | 249/196 |
| 3,160,940 | 12/1964 | Jennings | 249/191 |
| 3,246,869 | 4/1966 | Bowden | 249/47 |
| 3,315,938 | 4/1967 | Gates | 249/219 R |
| 3,357,672 | 12/1967 | Capek | 249/191 |
| 3,414,230 | 12/1968 | Brosseau | 249/45 |
| 3,862,737 | 1/1975 | Fustow, Jr. | 249/196 |

FOREIGN PATENTS OR APPLICATIONS

| | | | |
|---|---|---|---|
| 712,077 | 6/1965 | Canada | 249/40 |
| 23,742 | 11/1918 | Denmark | 249/40 |

*Primary Examiner*—Francis S. Husar
*Assistant Examiner*—John McQuade
*Attorney, Agent, or Firm*—Glenn B. Morse

[57] ABSTRACT

Metal wall form sections are adapted to a bolted tie system providing accurate spacing of the opposite panels defining a space to receive poured concrete. In the preferred form of the invention, interengagement of the form structure and the tie system (providing the spacing feature) is also used to secure the form sections laterally to each other. In another form of the invention, wedges transversely engaging the bolts bridge across and bear on the flanges of marginal beams of adjacent form sections to establish relative placement against the pressure of the concrete.

3 Claims, 14 Drawing Figures

MEANS FOR CONNECTING ABUTTING FORM PANELS AND FOR MOUNTING A TIE ROD

BACKGROUND OF THE INVENTION

It is standard practice to construct cement walls by first erecting a system of forms defining a space into which concrete is poured. The forms are essentially panels reinforced by various patterns of beams, the dimensional relationships being determined primarily by the depth of the pour and the resulting pressure of the poured concrete mass. Where the forms are intended for extensive re-use, panels of plywood or sheet steel are frequently provided with marginal steel beams to provide a modular unit that can be interconnected to form a system of any desired length.

Poured concrete will generate pressure of approximately 160 pounds per square foot per foot of depth, with the inevitable result that forms of any substantial size will require securing systems of tremendous strength. The most reliable of these involves an imbedded tie rod extending across the space between the forms, and which is submerged when the concrete is poured. This tie rod is threaded at both ends, and is engaged by bolts traversing the form panels and secured to the reinforcing beams supporting the panels. The pressure against each of the opposite form systems is thus equalized. The cross-sectional dimensions of each of the tie assemblies is inter-related with the spacing of them so that the concrete pressure is effectively resisted.

Form systems are used primarily by commercial contractors, and the overall cost of the procurement and use of the forms is therefore highly important. The initial cost of the form structure, having in mind the degree of re-use for which it is designed, must be considered along with the erection time of the form determined primarily by its tie system, and also the stripping time required to disengage the tie system and remove the forms from the completed concrete wall. Accuracy of spacing is obviously important, in order to preserve the dimensional continuity of the wall surface.

SUMMARY OF THE INVENTION

The present invention provides a tie system primarily for wall forms having at least the reinforcing structure of metal. The panels actually providing the confinement for the poured concrete may be sheet metal, plywood, or planking. The marginal beams defining the modular form sections are modified so that adjacent marginal beams together define openings receiving the bolts of the tie system. In the preferred form of the invention, the marginal beams are "I" shaped in cross-section, and the flanges of the beams are notched out opposite the points where the webs of the beams are deformed laterally in a generally semi-circular configuration. A locating pin traverses these web sections and also the bolt received between them to establish the spacing of the forms prior to the pouring of the concrete. In the simplest form of the invention, these locating pins (or bolts) are of sufficient cross-sectional area to function additionally as a stress-transfer for the forces generated by the poured concrete. Where these pressures are resisted by wedges interengaging the bolts transversely, the relative placement of the forms to maintain a coplanar relationship of the panels results from the bridging of the wedge across the adjacent marginal beams as the wedges bear against the outer surface of the flanges of these beams. With marginal beams of the same size, the beams are thus placed so that the outer flanges are in coplanar relationship, resulting in a similar relationship of the supported panels. Lateral clamping of the form sections can be provided by wedge abutments embracing adjacent marginal beams.

DESCRIPTION OF THE PREFERRED EMBODIMENTS

Figure 1:
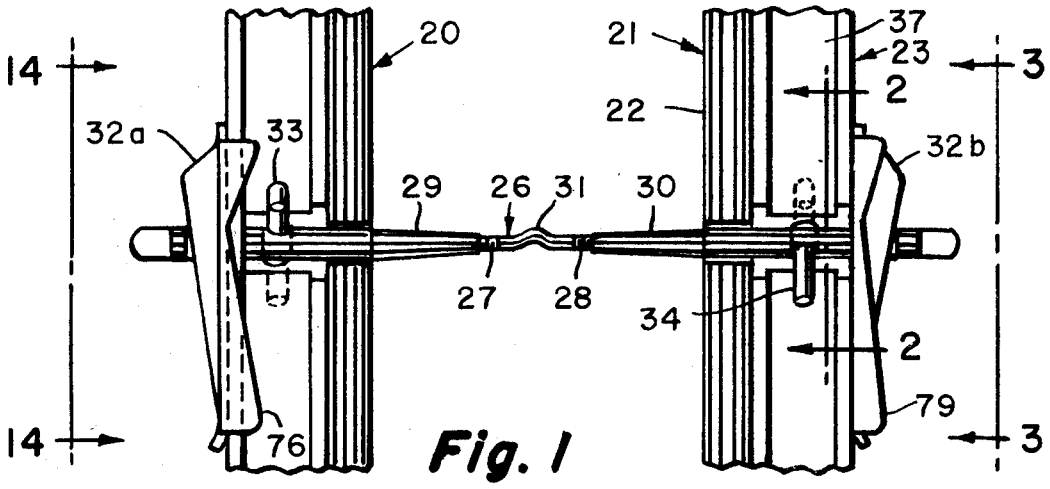
FIG. 1 is a section through a portion of a wall form system at one of the tie assemblies.
Figure 2:
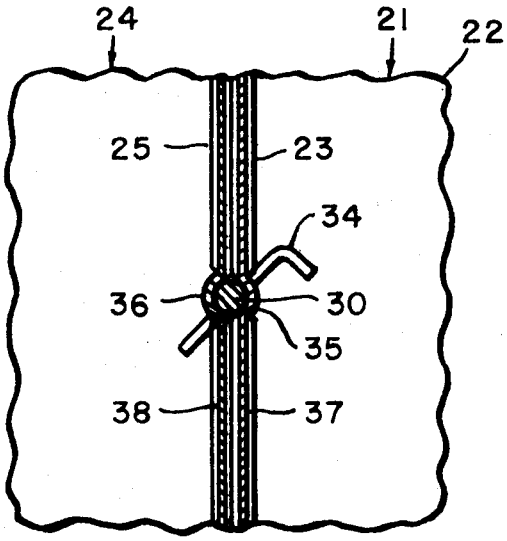
FIG. 2 is a section of the plane 2—2 of FIG. 1.
Figure 3:
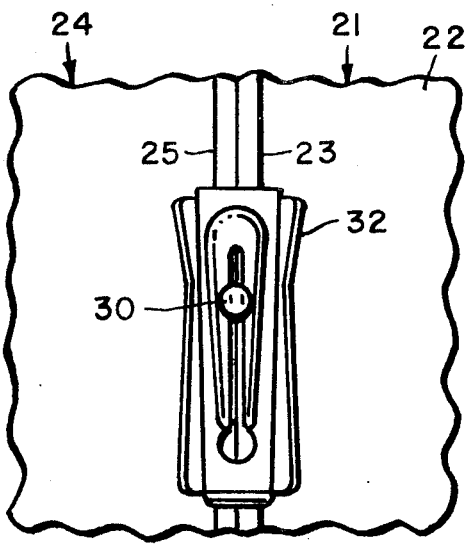
FIG. 3 is a section of the plane 3—3 of FIG. 1.

The form system shown in FIG. 1 includes the opposite sections 20 and 21, which are of the same construction. Each of these includes a panel 22 reinforced by marginal beams as shown at 23. Referring to FIGS. 2 and 3, the form section adjacent to the section 21 is indicated at 24, and is provided with the marginal beam 25 in side-to-side relationship with the marginal beam 23 of the form section 21. Preferably, these marginal beams are "I" shaped in cross section.

The inner tie rod 26 is threaded at its opposite ends 27 and 28 for interengagement with interior threading in the ends of the bolts 29 and 30, respectively. The tie rod 26 is offset as shown at 31 to provide rotative resistance when the bolts 29 and 30 are unscrewed after the concrete has set. The effect of this tie assembly is to transfer the pressure forces from the group of form sections of one side of the wall over to the form sections on the other side, thus equalizing these forces. The exterior bracing of the forms can thus be confined to relatively light structure for maintaining the vertical orientation. In the tie system shown in FIG. 1, the pressure of the concrete is transferred from the form sections to the tie assembly by the wedges 32*a* and 32*b* laterally interengaging broached flats on the bolts 29 and 30. These wedges rest flat against the outer flanges of the beams 23 and 25, thus establishing the coplanar relationship of the panels of the form sections 21 and 24. The initial accurate placement of the forms prior to the pouring of concrete is maintained by the locating pins 33 and 34, which traverse the laterally deformed sections 35 and 36 of the webs 37 and 38, respectively, of the marginal beams 23 and 25. Where the pins 33 and 34 are generally L-shaped as shown in FIG. 2, it is preferable to arrange the holes in the web sections 35 and 36 at an angle of approximately 45° to the horizontal to facilitate the retention of the pins after they are slipped into place. The tie assembly becomes a solid stress-transfer system without lost motion as soon as the wedges 32*a* and 32*b* are tapped downward in the position shown in FIG. 1, thus developing pressure between the wedges and the locating pins 33 and 34. As the concrete pressure develops, the function of the spacing pins 33 and 34 disappears.

Figure 4:
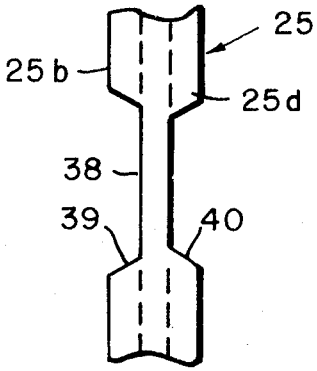
FIG. 4 is a view showing an intermediate configuration of the marginal beams preparatory to deformation of the web of the beams.
Figure 5:
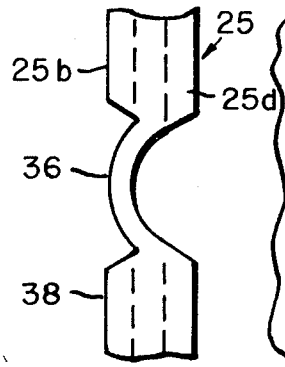
FIG. 5 is the illustration of the final form of the beams to establish half of the configuration for receiving a tie bolt.
Figure 6:
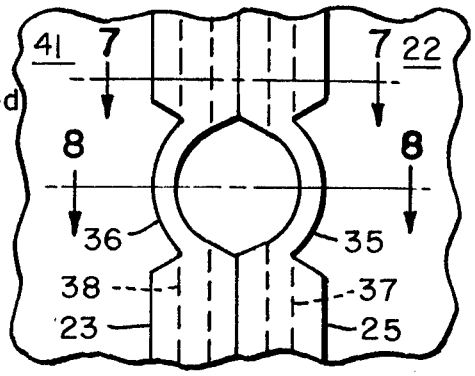
FIG. 6 illustrates the combined effect of beams formed as shown in FIGS. 4 and 5.
Figure 7:
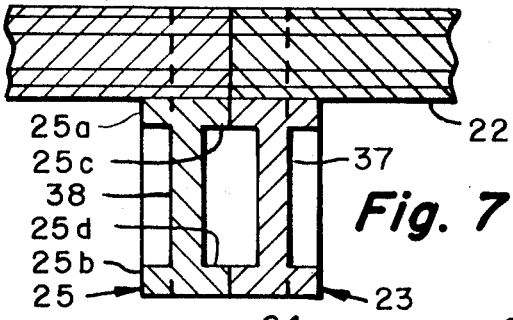
FIG. 7 is a section of the plane 7—7 of FIG. 6.
Figure 8:
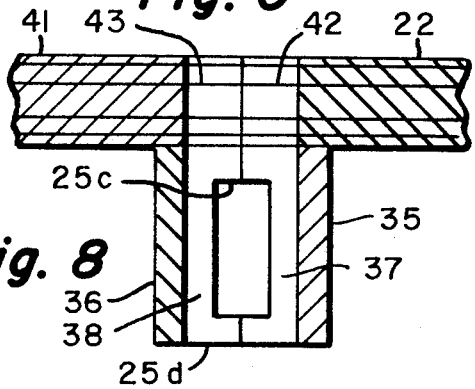
FIG. 8 is a section of the plane 8—8 of FIG. 6.
Figure 9:
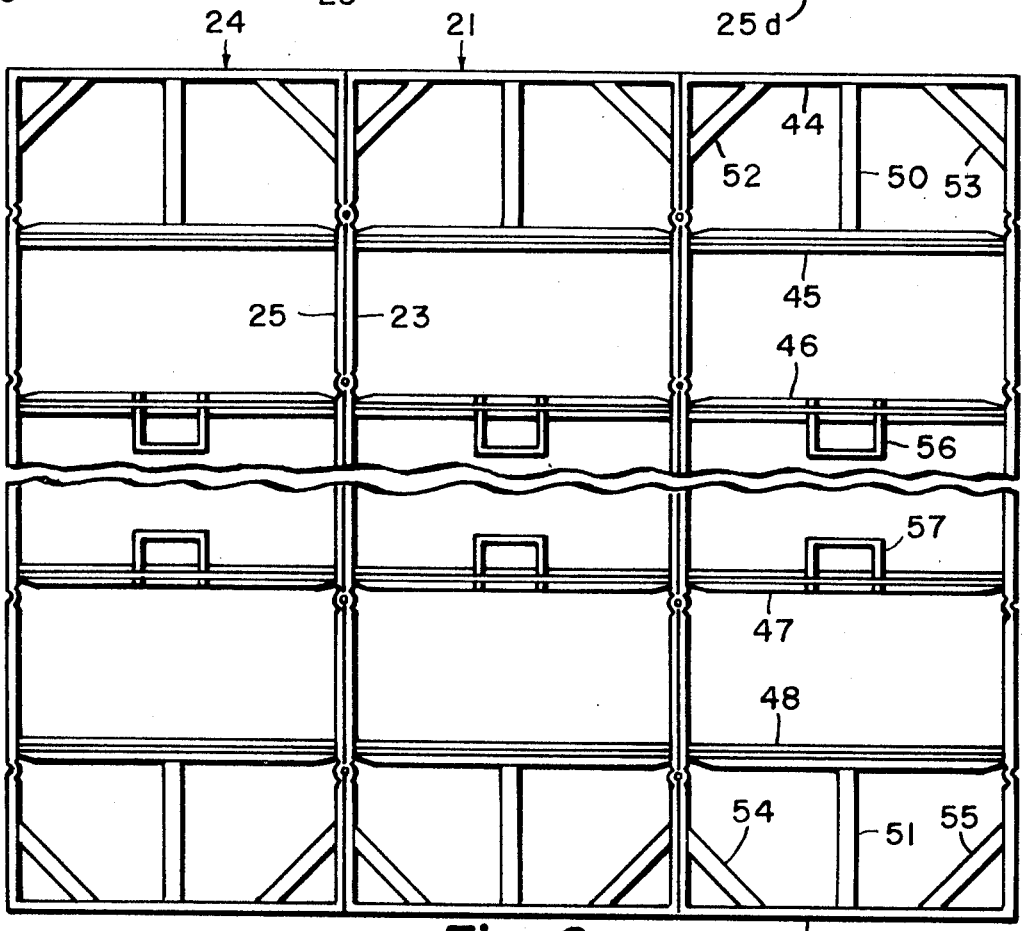
FIG. 9 is an elevation of a series of three form sections, viewed from the side opposite from that receiving the poured concrete, and shown without the tie systems present.

The modification of standard I beam cross sections to receive the tie bolts is best shown in FIGS. 4 and 5. On one side of the beam, the inner flange 25*a* and the outer flange 25*b* are notched to form a cutout as shown at 39. Similarly, the inner and outer flanges 25*c* and 25*d* on the opposite side of the beam are notched to form a cutout as shown at 40. This leaves the web 38 exposed, and more easily adapted to lateral deformation as shown at 36 in FIG. 5. The marginal beam 25 of the adjacent form section is oppositely prepared, with the two portions together defining an aperture as shown in FIG. 6 for receiving a tie bolt. The supported panels 22 and 41 are similarly provided with semi-cylindrical discontinuities 42 and 43 in alignment with the passages provided by the web sections 35 and 36. When adjacent form sections are placed together in edge-to-edge relationship establishing a form system on one side of a wall, they appear as shown in FIG. 9 prior to the installation of the tie systems. Where the marginal beams are channel-shaped in cross-section, the webs are preferably at the periphery, and the flanges on the one side are cut out as shown in FIG. 4. The structure appearing in FIG. 9, in addition to that previously described, is subject to choice, and will usually include horizontal members as shown at 44–49, auxiliary verticals as indicated at 50 and 51, and corner diagonals 52–55. The U-shaped members 56 and 57 will ordinarily be added as connecting points for lifting equipment or handling.

Figure 13:
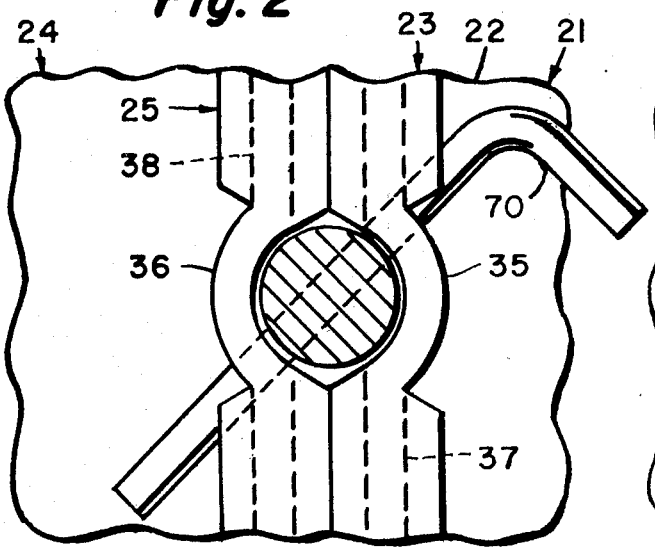
FIG. 13 (sheet 1) is a section on a plane 13—13 of FIG. 12.
Figure 14:
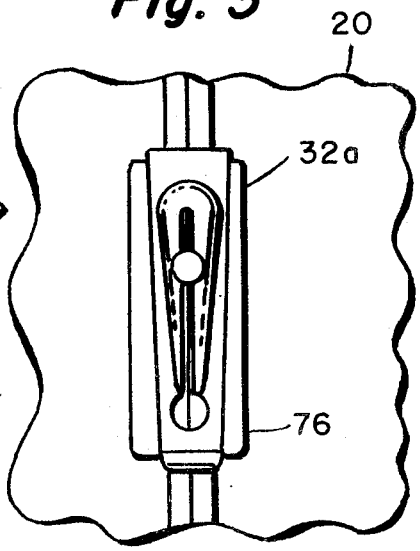
FIG. 14 (sheet 1) is a view in elevation on the plane 14—14 of FIG. 1.
Figure 10:
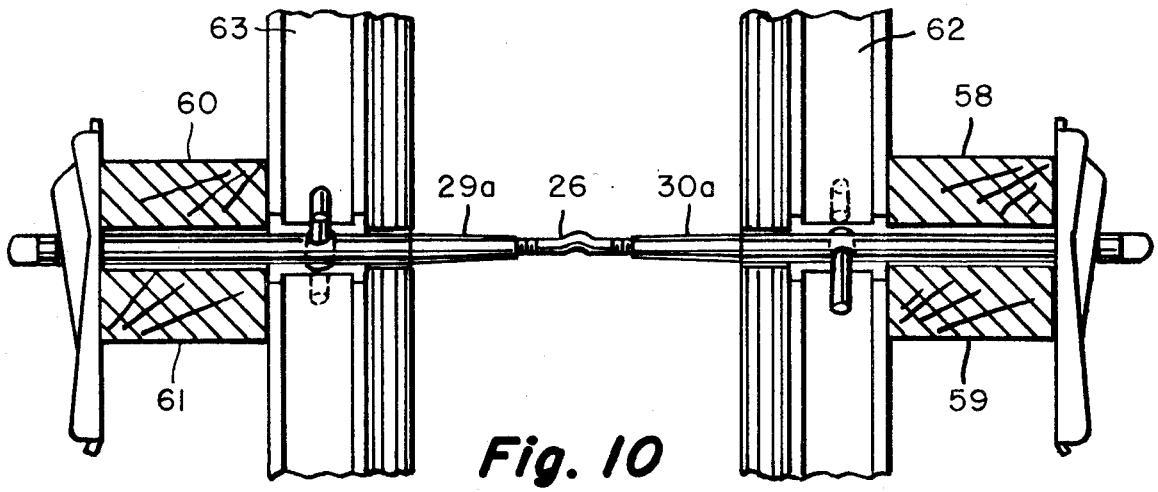
FIG. 10 is a section similar to FIG. 1, showing a modified form of the invention adapted for the use of conventional walers.
Figure 11:
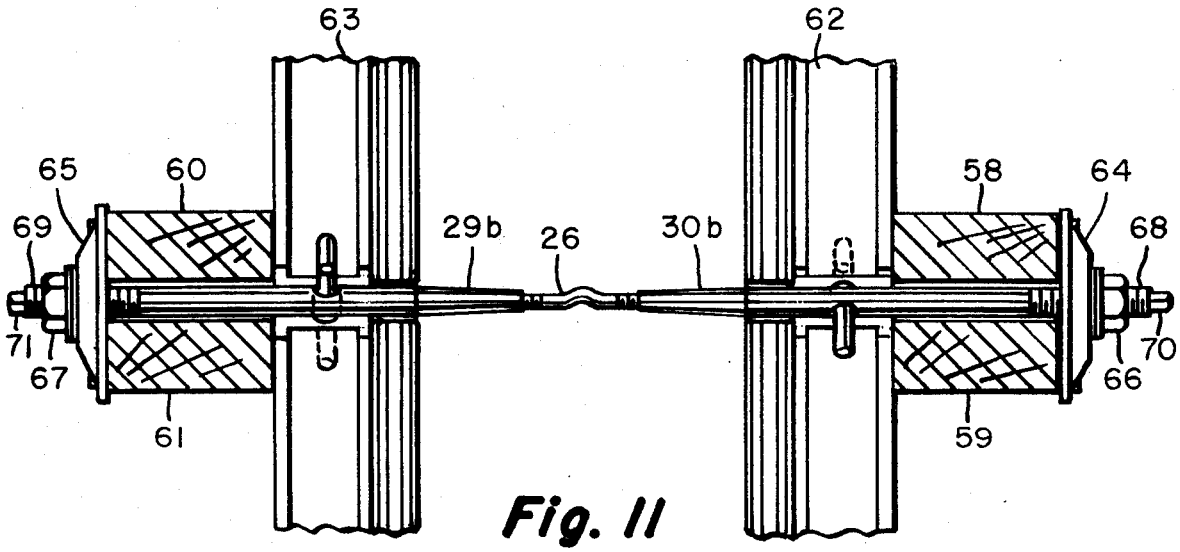
FIG. 11 is a view similar to FIG. 1, showing a further modification of the invention utilizing walers.
Figure 12:
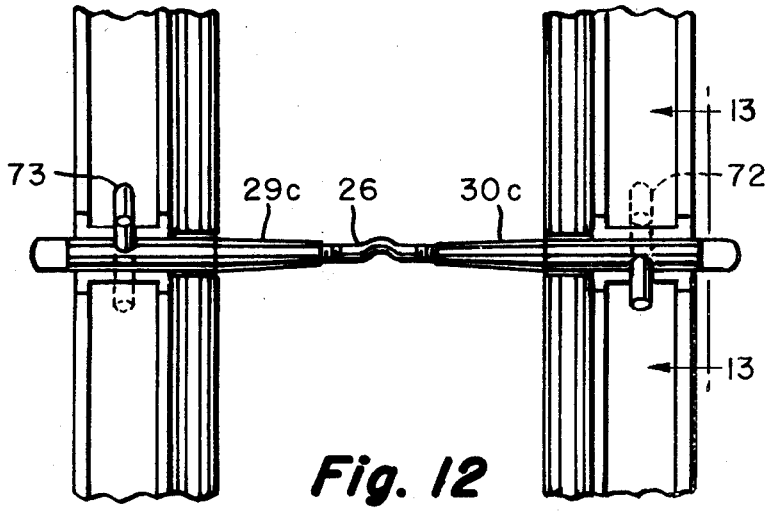
FIG. 12 is a view similar to FIG. 1, and illustrates a further modification of the invention which eliminates walers and clamping devices.

Referring to FIG. 10, the arrangement shown in FIG. 1 can be modified to the extent of providing conventional waler beams 58–59 and 60–61 as a means of reinforcing the support of the form sections 62 and 63. With the use of walers, it is possible to use a somewhat greater spacing of the tie systems. The walers become clamped between the effects of the wedges and the spacing pins. In the FIG. 11 modification, the wedges are replaced by the bearing brackets 64 and 65 and the nuts 66 and 67, respectively. This type of securing requires bolts having threaded ends as shown at 68 and 69. The outer ends of tie bolts in all these cases are provided with flats as shown at 70 and 71 to receive wrenches used in installation and removal. In FIGS. 12 and 13, the L-shaped locating pins 72 and 73 intersect the bolts 29 and 30 as shown, and are responsible for holding the forms together edgewise because of the 45 degree angle of these pins to the horizontal. Where the FIG. 1 arrangement is used, the lateral clamping of the forms can be provided by a portion of the wedges 32*a* and 32*b* extending toward the respective panels to embrace the adjacent marginal beams and hold them together. A reversal of the wedge flanges as shown at 76 in FIG. 1 will provide this feature.

I claim:

1. A modular form system including a plurality of units assembled edge-to-edge in coplanar relationship each including a panel adapted to confine poured concrete, marginal beams adjacent the vertical edges of said panel and secured thereto, said beams each having a web portion normal to said panel and flanges along said web portion generally parallel to said panel, and a plurality of tie assemblies including bolt means traversing said panels and secured with respect thereto, wherein the improvement comprises:

laterally-offset web portions on said marginal beams and panel on the edges thereof defining the edge periphery of each of said units, said laterally-offset web portions on adjacent beams and panels together defining an opening receiving said bolt means at least at positions intermediate the corners of said units, said opening conforming closely to the cross-sectional configuration of said bolt means, and said flanges being absent at the laterally-offset web portions; and means securing said units laterally in edge-to-edge relationship.

2. A form system as defined in claim 1, additionally including locating means intersecting said web at said offset portions and also intersecting said bolt means disposed therein.

3. A form system as defined in claim 2, wherein said locating means is a pin disposed at a substantial angle to the horizontal.

* * * * *